United States Patent [19]

Lee

[11] Patent Number: 4,650,433

[45] Date of Patent: Mar. 17, 1987

[54] WATER SKI WITH PROPULSION GUIDE POLES

[76] Inventor: Kie S. Lee, 5715 Columbus Ave., Van Nuys, Calif. 91411

[21] Appl. No.: 736,647

[22] Filed: Apr. 26, 1985

[51] Int. Cl.[4] ..... A63C 15/00; A63C 15/08

[52] U.S. Cl. ..... 441/65; 416/70 R; 440/101

[58] Field of Search ..... 441/65, 68, 74, 76, 441/77, 79; 440/101; 416/70 R

[56] References Cited

U.S. PATENT DOCUMENTS 2,940,090 6/1960 Fournier ..... 441/77
3,027,575 4/1962 Fortin ..... 441/68

FOREIGN PATENT DOCUMENTS 929149 12/1947 France ..... 441/65
901112 7/1962 United Kingdom ..... 441/76

*Primary Examiner*—Sherman D. Basinger
*Attorney, Agent, or Firm*—Beehler, Pavitt, Siegemund, Jagger, Martella & Dawes

[57] ABSTRACT

A single water ski and propulsion pole combination makes use of a buoyant hull of sufficient width to accommodate both feet of the user. Two buoyant poles are included, each adapted to be grasped at one end. On the opposite end of each pole is a propulsion plate and beneath the propulsion plate is a rigid end section. The deck of the hull is equipped with holes, one on each side of the hull, into which the rigid end sections of the poles may be thrust to store the poles in a fixed upright position when not in use for propulsion, leaving the deck clear and available for the user.

1 Claim, 5 Drawing Figures

Fig. 1.
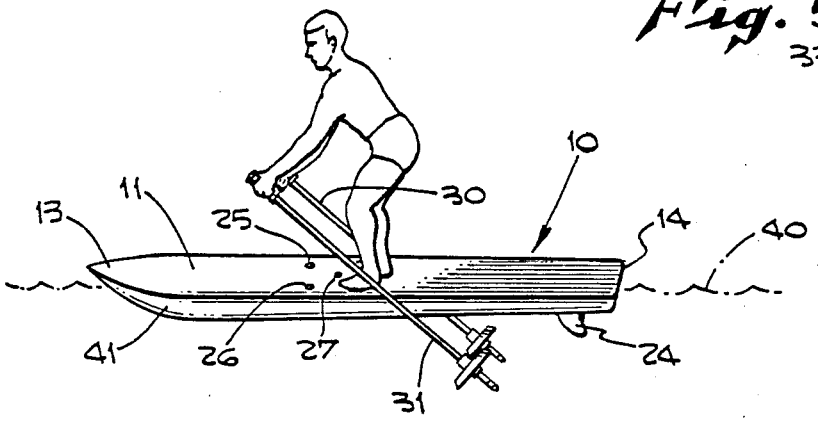
Fig. 5.
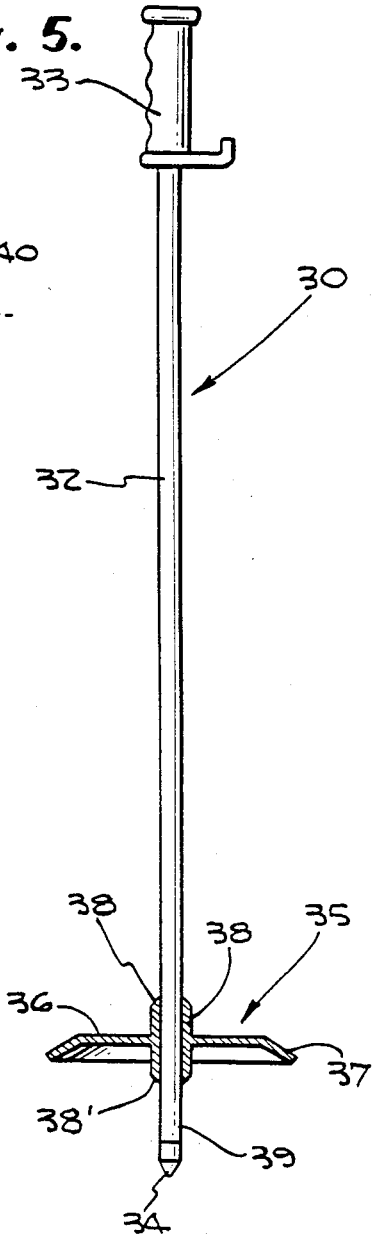
Fig. 2.
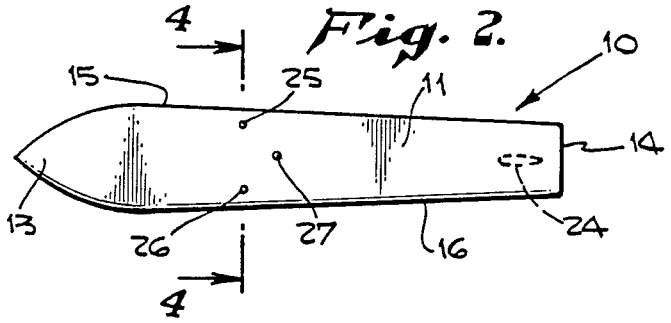
Fig. 3.
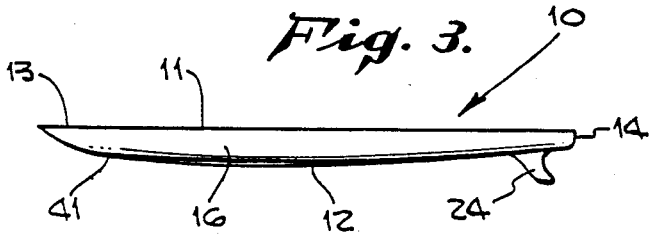
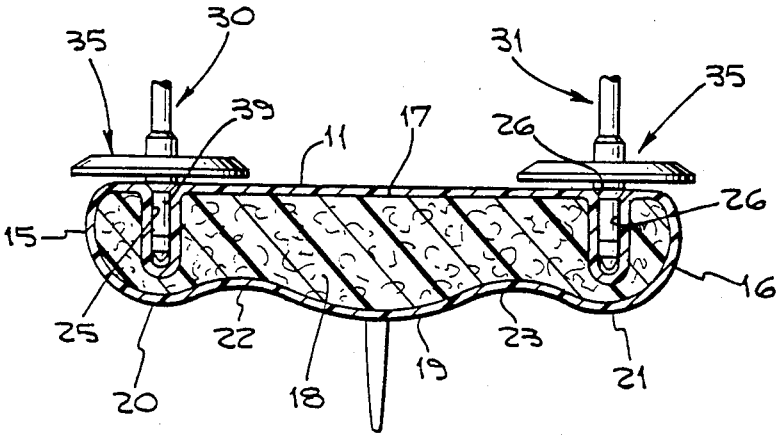
Fig. 4.

WATER SKI WITH PROPULSION GUIDE POLES

The invention has reference to a combination of single hull water ski and appropriate propulsion guide poles which have a direct relationship with respect to the utility of the ski.

Appreciable interest has been evidenced in self-propelled water ski equipment featuring not only a single hulled water ski but propulsion means of one form or another, usually poles. Water skis, however, when not used for surfing, experience a problem in that the poles are in fact the only means of propulsion to move the ski through the water. There is also the problem of buoyancy in that there must be sufficient buoyancy embodied in the ski itself so that it rides well above the water surface while the user not only propels it but also balances it, often in relatively rough water. Ski equipment of the type made reference to has tended in the past to undertake the solution of multiple problems, the result being that the equipment has tended to be more complex than is acceptable to the average ski enthusiast.

It is therefore among the objects of the invention to provide a new and improved propulsion pole and single water ski combination which affords adequate balance, taking into consideration the weight of the user, balance in a lateral direction being of particular importance without, however, neglecting fore and aft balance.

Another object of the invention is to provide a new and improved propulsion pole and single water ski combination of design such that the user can hold the equipment in a chosen direction without troublesome drift laterally such as would be experienced for example, with a sailboat without a keel.

Still another object of the invention is to provide a new and improved propulsion pole and single water ski combination which is relatively simple in its construction, thereby to minimize the learning problem and to maximize the recreational utility for a relatively low manufacturing cost.

Still further among the objects of the invention is to provide in combination a single hull water ski of adequate breadth permitting the user to balance with his feet in side by side relationship, assisted by propulsion poles, one in each hand, which not only satisfy the need for propulsion and steering, but also can be interconnected with the hull of the ski itself to provide not only storage for the poles, but also to permit the user to make use of the single water ski otherwise as, for example, merely for resting prone on the ski while adequately buoyed above the surface of the water either close to shore or elsewhere.

A still further object of the invention is to provide a new and improved propulsion pole in single water ski combination which is in an arrangement such that the user can manipulate the combination in liberal positions such, for example, as sitting and kneeling, as well as in a standing position.

Further included among the objects of the invention heretofore made reference to, is a combination which avoids vacuum problems when the pole is thrust into the water, such as have been experienced in other types of propulsion poles, with the result that the ski can be ridden relatively fast when the user makes use of a maximum propelling thrust.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

In the drawings:

FIG. 1 is a side perspective view of the propulsion pole and single water ski combination showing the equipment in use by an opertor.

FIG. 2 is a top plan view of the single hull water ski.

FIG. 3 is a side elevational view of the ski.

FIG. 4 is a cross-sectional view on the line 4—4 of FIG. 2.

FIG. 5 is a side elevational view of one of the propulsion poles, partially in section.

In an embodiment of the invention chosen for the purpose of illustration, there is provided a water ski comprising a single hull 10 having a deck 11, a bottom 12, a bow 13, and stern 14. Starboard and port sides 15 and 16, respectively, extend from the bow 13 to the stern 14. In the chosen embodiment the hull is shown provided with an exterior shell 17 which completely envelops the hull. The hollow interior of the shell is preferably filled with a non-absorbent, lightweight, buoyant filler 18. A variety of types of commercial synthetic plastic resin material is available as fillers as, for example, those found acceptable in the manufacture of surfboards. The shell can be appropriately formed of a material such, for example, as fiberglass impregnated with an appropriate resin of a variety employed successfully in the construction of boat hulls. The shell in any event should be sufficiently firm so as to hold its shape when in use, both with respect to the deck 11 and the bottom configuration.

As an expedient for avoiding prospect of lateral drift during use, the bottom 12 of the hull is provided with a transversely arcuate central keel 19 with a starboard peripheral keel 20 and a port peripheral keel 21. An arcuate recess 22 interconnects the starboard peripheral keel 20 with the central keel 19. On the opposite side an arcuate recess 23 interconnects the port peripheral keel 21 with the opposite side of the central keel 19. A rigid fixed rudder 24 is installed at the stern a short distance forward of the sternmost point to further the ability of the user to keep the hull on course when in use.

Of special consequence is the provision of holes 25 on the starboard side and 26 on the port side. In the chosen embodiment, the holes are molded initially as portions of the shell 17 so that they are strong and rigid. The holes penetrate the interior of the shell where they are surrounded by the filler 18 of whatever material may have been chosen.

It is further of significance that the deck 11 be provided with a supporting area 27 at a location more or less midway between bow and stern but, in any event, of sufficient width to accommodate the feet of the user in side by side relationship. The holes 25 and 26, two in number in the chosen embodiment, are preferably located slightly forward of the supporting area and at the laterally outermost sides of that area.

For propulsion the combination is provided with two poles 30 and 31. The propulsion poles being identical, only one is shown in detail in FIG. 5.

The propulsion pole 30 or 31, as the case may be, is appropriately built with a hollow shaft 32 of material such as aluminum for the entire length of the pole. At the upper end a handle member 33 of material exemplified by commercially available plastic or rubber, extends over the shaft and provides a closure. At the opposite end, the hollow interior of the shaft is closed by other appropriate means as, for example, by application of an aluminum or plastic tip 34. The hollow shaft 32, closed at both ends, is bouyant so as to float, should it be dropped in the water.

Adjacent to but removed from the end 34 is a propulsion medium which, in the chosen embodiment, is in the form of a rigid plate-like element 35. The element 35 has a relatively flat central area 36 at the perimeter of which is an outer rim 37 slightly cupped in the direction of the lower end of the shaft.

The element 35 is additionally provided with a collar 38 extending on both sides of the central area 36, and having a rugged construction. The location of the collar 38 on the shaft 32 is such as to provide a rigid end section 39 of adequate length between the lower end of the shaft 32 and the location of the plate-like element 35.

There are bevelled edges 38' on the collar 38, the lower of which is received in the upper end of the hole 26 which has a tapered edge 26' for reception of the respective bevelled edge 38'. The holes 25 and 26, previously made reference to, have each a depth exceeding the length of the rigid end section 39 so that when the pole is stowed in the hole there is a clearance between the deck of the ski and the rim 37 of the plate-like element 35.

Although the propulsion poles 30 and 31 are effectively designed for used in propelling the single hull 10 through the water, they are additionally designed to be stowed in the holes 25 and 26 wherein they are held in rigid erect position with respect to the deck 11. In that position they can serve as a means for balancing the stance of the user when standing on the supporting area and additionally serve as a storage means for the poles, should the user wish to discontinue propulsion and recline prone on the deck while the hull is floating on the surface 40 of water above a water line 41 on the hull, or in the event that the hull should be temporarily pulled ashore. Further still, should there be occasion, for example, to pull the hull in some fashion, stowage of the propulsion poles in the holes in firm position as described enables the user to merely ride the deck of the hull while grasping the poles for support.

While a particular embodiment of the present invention has been shown and described, it will be obvious to those skilled in the art that changes and modifications may be made without departing from the invention in its broader aspects and, therefore, the aim of its appended claims is to cover all such changes and modifications as fall within the true spirit and scope of this invention.

Having described the invention, what is claimed as new in support of Letters Patent is as follows:

1. A water ski propulsion pole combination comprising a single hull ski of buoyancy sufficient to support the weight of a user above the waterline on the hull, a deck on the hull above the waterline having a supporting area of width sufficient to accommodate the user's feet, and a pair of buoyant propulsion pole assemblies, each pole assembly comprising a shaft, a handhold at one end of the shaft, a relatively thin rigid propulsion medium in a fixed transverse position adjacent the other end of the shaft and a rigid end section of the shaft extending outwardly from the plane of the propulsion medium to the endmost tip of said other end of the shaft, said propulsion medium having a flat central area with an outer rim slightly cupped so as to present a concave side facing said other end of the shaft, said deck having at least one hole adjacent each side of the supporting area, each said hole receiving a substantial portion of one of said rigid end sections for releasably holding each pole assembly in an upright position, a collar portion extending between said propulsion medium and said rigid end section, each said hole having a tapered top edge, each said collar portion being received in said tapered top edge such that said propulsion medium is spaced from said deck when said pole assembly is held in said upright position.

* * * * *